United States Patent [19]

Fontana

[11] 4,443,002

[45] Apr. 17, 1984

[54] RACETRACK GUARD

[76] Inventor: Richard Fontana, 8525 Bella Vista, Alta Loma, Calif. 91701

[21] Appl. No.: 360,231

[22] Filed: Mar. 22, 1982

[51] Int. Cl.[3] ..... E04H 17/14

[52] U.S. Cl. ..... 256/59; 119/29

[58] Field of Search ..... 256/59, 64, 65, 66, 256/DIG. 6, 31, 47, 13.1; 119/29, 15.5

[56] References Cited

U.S. PATENT DOCUMENTS

| | | | |
|---|---|---|---|
| 1,614,795 | 1/1927 | Lookabaugh | 256/31 X |
| 3,638,913 | 2/1972 | Persicke | 256/13.1 |
| 3,674,115 | 7/1972 | Young et al. | 256/13.1 |
| 3,789,801 | 2/1974 | Moreng | 119/29 |
| 4,078,773 | 3/1978 | Ellingson | 256/65 |

FOREIGN PATENT DOCUMENTS

| | | | |
|---|---|---|---|
| 1445853 | 8/1976 | United Kingdom | 256/66 |

*Primary Examiner*—Wayne L. Shedd

*Attorney, Agent, or Firm*—George F. Bethel; Patience K. Bethel

[57] ABSTRACT

A racetrack guard is disclosed which includes a plurality of spaced-apart upright gooseneck curved posts or stanchions. The exposed ends of the posts or stanchions are covered by and attached to a rail which runs from post to post. On the top of the posts or stanchions are disposed a number of generally L-shaped elongated panels in overlapping relationship from end to end. The panels are attached to the rail and to the stanchions. The panels, which are formed of a resilient, shock absorbing material, overlie the posts to provide a cushioning or shock absorbing surface. These conditions are extremely desirable in protecting a jockey from a serious injury in the event of a fall from a horse during a race.

18 Claims, 6 Drawing Figures

RACETRACK GUARD

BACKGROUND OF THE INVENTION

1. FIELD OF THE INVENTION

This invention relates to the field of racetrack guardrails, and particularly, to an improved shock absorbing guardrail, which will minimize the shock of impact of a jockey on the guardrail surfaces.

2. DESCRIPTION OF THE PRIOR ART

Historically, racetracks have been bounded by a barrier in the form of a fence to isolate the racing animals with riders from the spectators. The earliest types of fencing which were used were in the form of various types of standard wooden fences, such as post and rail, board fences, and in parts of England, even hedges and hedgerows. Such barriers performed the job fairly adequately of containing the racing horses. However, upon impact of a rider or horse with the fence, it was inclined to break. This allowed the spectators at times to be endangered from falling horses and riders. More importantly, however, the breaking of the standard wooden fences with the accompanying splintering of the wooden materials of which they were made, created potentially lethal jagged edges, as well as projecting parts upon which the horse and/or rider were sometimes impaled.

With the above in mind, the standard wooden fences were replaced by a stronger railing, usually composed of a wooden or metal continuous rail which bridged separate posts around the racetrack. These newer rails were much improved over the standard fencing. However, problems were still being created by collision of horses and riders with the railing, as well as with the stanchions.

The next improvement involved replacing the vertical posts or stanchions with curved gooseneck projecting stanchions which held the rail itself away from the stanchions. While this constituted quite an improvement over the prior railings, there was still a significantly dangerous condition created whenever a rider or horse fell or was impacted by the metal stanchions or posts. Broken backs are not an uncommon injury for jockeys who collide with metal posts. Horses are also subject to serious injury, including broken legs.

It is to the improvement of the railing which is supported by curved gooseneck stanchions that this invention is directed. The object of the invention, then, is to provide a shock absorbing surface for cushioning the impact of horse or rider on the guardrail itself and at the same time avoid impact with any hard or sharp surfaces.

According to a preferred embodiment, the racetrack guard includes an embossed pattern which directs the fallen jockey away from the track toward the infield.

SUMMARY OF THE INVENTION

The present invention utilizes a plurality of spaced-apart upright gooseneck curved posts, or stanchions in which the curve is oriented at right angles to the track surface. Covering the exposed ends of the posts or stanchions is a rail formed of segments of wood or metal which are attached end to end to form a continuous railing around the racetrack. Overlying the top portion of the stanchions and attached to the rail are a plurality of generally L-shaped elongated segments or panels arranged in overlapping relationship from end to end.

The segments or panels are attached one to another to form a continuous surface, as well as to the rail and to the curved stanchions. The elongated panels are formed of a resilient, shock absorbing material, such as plastic, rubber, or a deformable metal sheeting. These panels can be embossed for extra strength and to direct a fallen jockey away from the track toward the infield.

In their preferred embodiment, the panels include a major flat or horizontal upper surface which can include a flange to accommodate the point of attachment on the rail. The panels, while attached to the rail and to the posts at the panel edges, do not contact the posts in other areas. As a result, upon impacting the panel surfaces, there is an ability of the panel to deform and cushion the shock without contacting the extremely hard surface of the stanchion or post. At the same time the resiliency of the panel coupled with a unique embossing design has the effect of urging the fallen rider up and off the panel in the direction of the infield. Initial studies have shown greatly reduced injuries with the use of the above described shock absorbing racetrack guardrail.

DESCRIPTION OF THE DRAWINGS

The invention will be more clearly understood by reference to the description below taken in conjunction with the accompanying drawings wherein.

DETAILED DESCRIPTION OF THE INVENTION

Figure 1:
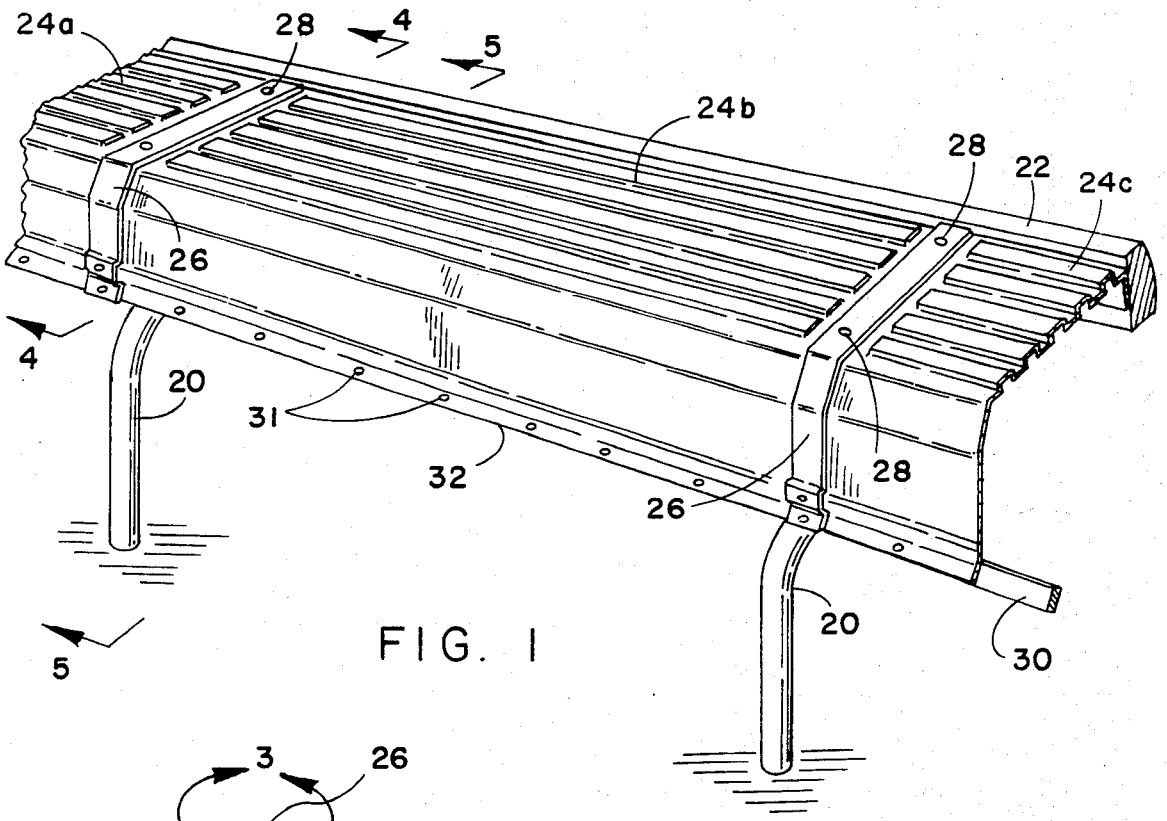
FIG. 1 shows a perspective view of a section of the racetrack guard of the invention.

Referring now to FIG. 1, there is seen in perspective one segment of the racetrack guard of the invention. As shown, the racetrack guard is supported by means of posts or stanchions 20 which have a gooseneck curve which is oriented toward the racetrack. At the exposed end of each post or stanchion 20 is attached a rail 22. The purpose of the rail is to provide integrity to the overall structure, as well as to cover the protruding ends of the stanchions or posts 20.

In the embodiment shown, the rail is composed of wood. However, other materials besides wood can be employed, such as, for example, plastics, metals, and the like, alone or in combination.

Attached to the rail 22 and to a mid-portion of the posts or stanchions 20 are a plurality of elongated panels or shell-like members **24*a*, 24*b* and 24*c*. Each panel is substantially L-shaped in cross-section and is joined to its next adjacent panel by means of an overlapping connection 26**. However, the panels can be curved in cross-section.

Figure 2:
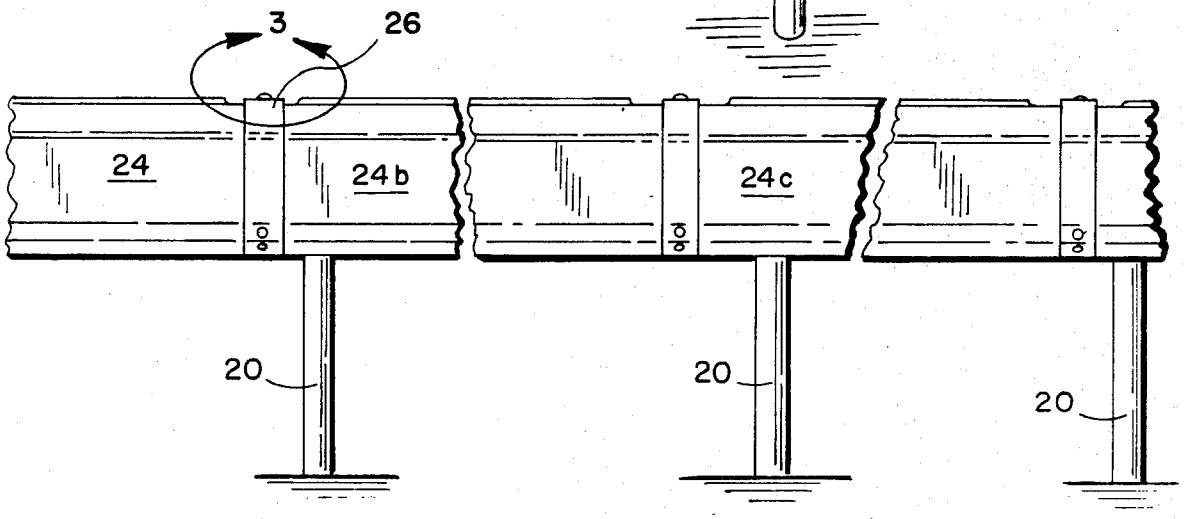
FIG. 2 shows a side elevation view of the racetrack guard of the invention.
Figure 3:
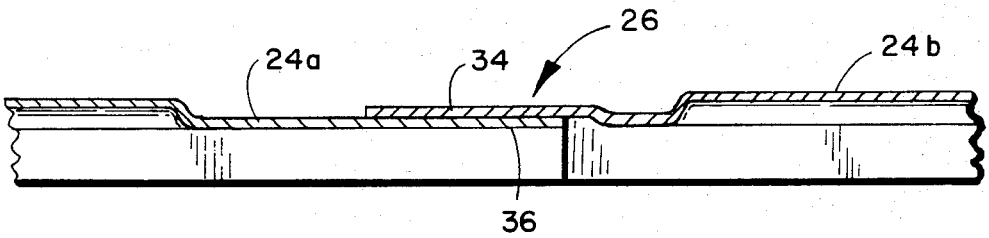
FIG. 3 shows a detail of the overlapping joint indicated at 3 in FIG. 2.

A side elevation of a racetrack guard is shown in FIG. 2 with panels **24*a*, 24*b* and 24*c* being joined to one another. The coupling or joint 26 is detailed in FIG. 3 and shows the overlapping sections of panels 24*a* and 24*b*. It can be seen that there is an enlarged margin or border 34 within panel 24*b* which is somewhat larger than the margin or border 36 of panel 24*a*. This permits the easy overlapping of margin 34 over margin 36 and the subsequent attachment by means of rivets 28 as shown in FIG. 1**.

Figure 4:
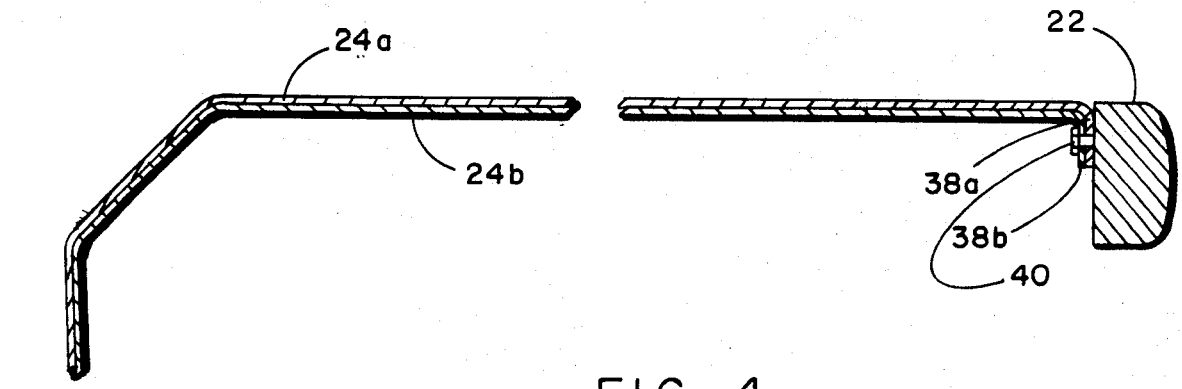
FIG. 4 shows a section taken along the lines 4—4 of FIG. 1.

A section through joint 26 can be seen in FIG. 4. Here, panel 24*a* is shown in overlapping relationship to panel 24*b*.

Figure 5:
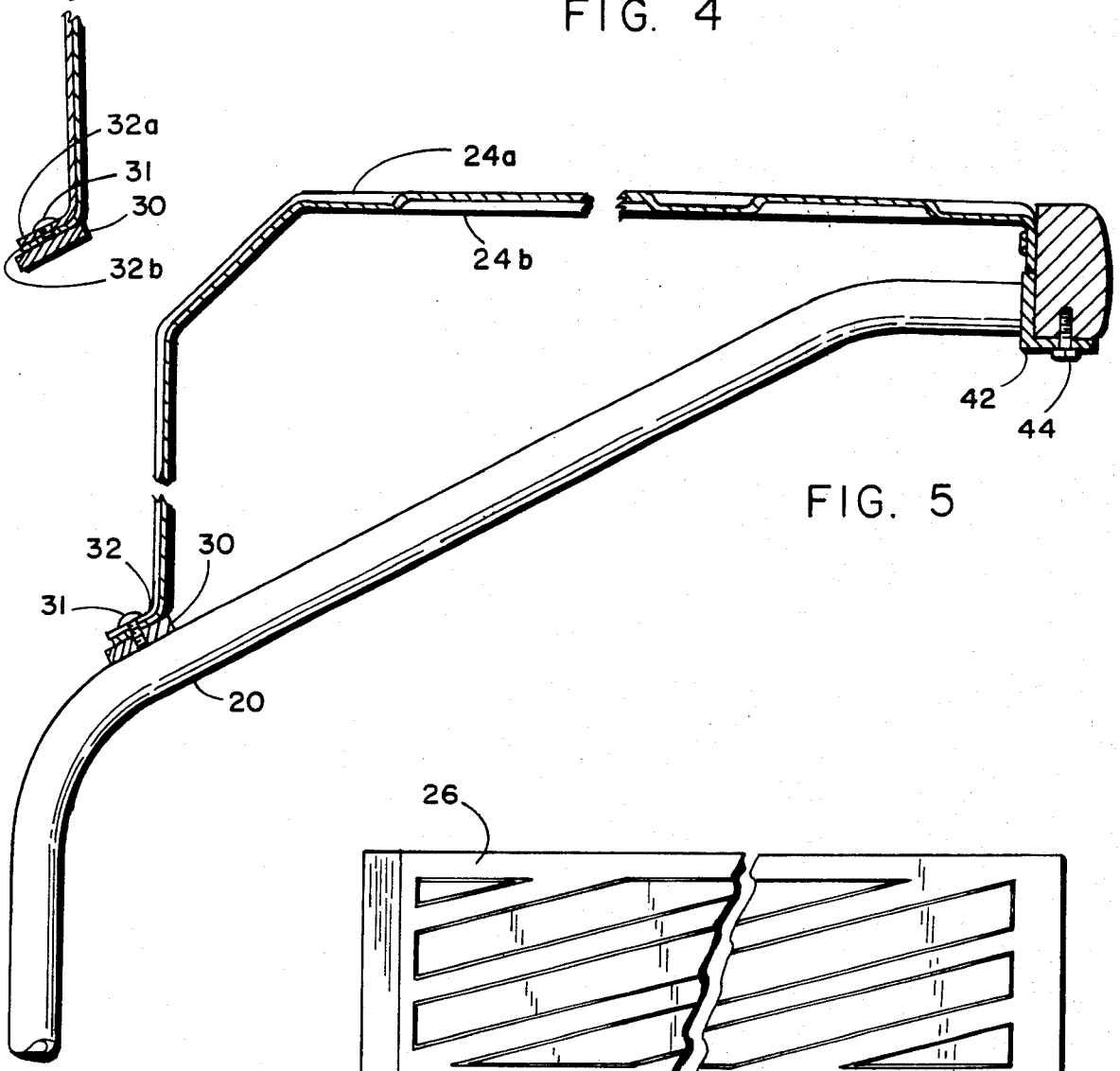
FIG. 5 shows a section taken along the lines 5—5 of FIG. 1.

Referring to FIG. 5 there is shown the attachment of the panels 24*a* and 24*b* to the post 20 and the rail 22. It should be noted that the post 20 has a gooseneck configuration which includes a double bend. This configuration is preferred as it has been found to be particularly strong when compared to a smooth curve gooseneck. While the double bend gooseneck is preferred, the smooth curve gooseneck can also be used.

Looking more particularly at FIG. 5, it can be seen that there is an L-shaped metal bracket 42, one side of which is welded to the end of post 20. The remaining side of the L-shaped bracket 42 is secured to the rail 22 by means of a bolt 44. Thus, the rail 22 is attached and covers the end of the post 20. This effectively shields the end of the post 20 from impact which would be potentially quite dangerous.

It can be seen in FIGS. 4 and 5 that the upper lengthwise edges of panel 24*a* and 24*b* are bent downwardly at a right angle to form skirts 38*a* and 38*b*. The skirts 38*a* and 38*b* are attached to the upper side portion of rail 22 by means of bolts 40 at spaced intervals along the length of rail 22.

The remaining lengthwise edges of panel 24*a* and 24*b* respectively are bent at a slightly upward angle to form flanges 32*a* and 32*b*. The flanges 32*a* and 32*b* in turn, are attached by means of bolts or metal screws 31 to a narrow metal strip 30 which is connected to and spans the posts 20. The bolts or screws 31 are threaded along the length of the flanges 32*a* and 32*b* to the metal strip 30. Thus, the panel is attached by its edges to the rail 22 and the posts 20.

It can be seen that the panels 24 have a substantially L-shaped configuration wherein the angle is beveled to avoid sharp edges and add strength. The angle of the panels permits the panel 24 to be attached along its lengthwise edges to the post 20 and to the rail 22 without touching or contact between the posts and the body of the panel 24. This can be seen in detail in FIG. 5. This condition allows the panel to deform and cushion upon impact without contacting the unyielding solid post or stanchion 20. Thus, when a jockey is thrown off a horse, he will be protected from contact with the hard post and will be cushioned by the panel 24.

The panels are preferably formed of a resilient shock absorbing material such as plastic, aluminum, sheet metal, or reinforced plastic. In the embodiment shown, the panel is formed of a plastic which has been embossed for additional strength, to enhance the attractiveness and overall appearance thereof.

Figure 6:
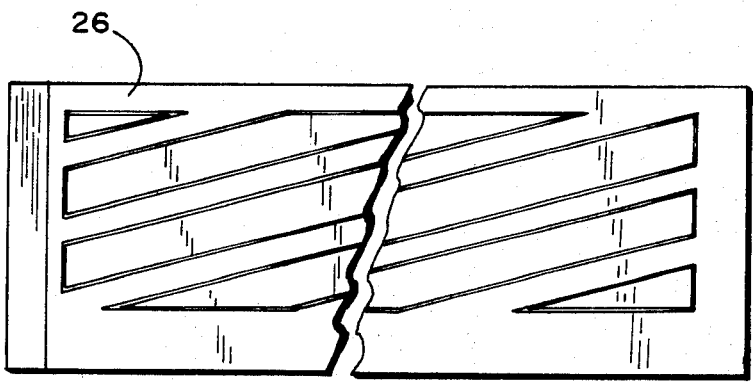
FIG. 6 shows a plan view of the racetrack guard of the invention.

According to a preferred embodiment as shown in FIG. 6, the major surface of the panel 24 is embossed with a pattern which slants away from the inside of the track toward the infield. When this panel is impacted by a jockey, his momentum and the resilient nature of the panel cause him to be directed or urged toward the infield and away from the track. The effect can be compared to the action of a trampoline.

It is an important feature of the invention to eliminate projecting sharp corners or other protruding parts which might cause a sharp point of injury upon impact. For this reason, it is preferred that the rail be rounded and the panels be formed in a relatively smooth configuration. Also, preferably, the bolts and rivets are either countersunk, smooth topped, or flush with the surface of the panels at their points of attachment.

The racetrack guard of the invention provides a plurality of overlapping panels which are supported by a number of gooseneck curved posts. One of the lengthwise edges of the panel is attached to the posts through a metal strip which runs from post to post. The remaining lengthwise edge of the panel is attached to a rail, which is also attached to the exposed ends of the posts.

The panels, which are formed of a resilient shock absorbing material, touch the post only at the point of attachment. Thus, a cushioning or shock absorbing surface is presented for purposes of protecting a jockey from serious injury upon impact.

Various modifications of the invention are contemplated and can be resorted to by those skilled in the art without parting from the spirit and scope of the invention as defined by the following claims.

I claim:

1. A racetrack guard comprising:

a plurality of spaced-apart fixed curved posts;

a rail attached to each post at its end;

a plurality of elongated panels arranged substantially from end to end and overlying said posts at said posts' upper curved portion; and, means to attach said panels to said posts and to said rail.

2. A racetrack guard as claimed in claim 1 wherein:

said elongated panels include a substantially major surface overlying said posts over said posts' curved portion.

3. A racetrack guard as claimed in claim 1 wherein:

said panels are substantially L-shaped and said posts have a gooseneck shape.

4. A racetrack guard as claimed in claim 3 wherein:

said elongated panels are formed of a resilient material to absorb shock.

5. A racetrack guard as claimed in claim 4 wherein:

said resilient material is plastic.

6. A racetrack guard as claimed in claim 3 further comprising:

a narrow metal strip attached to and running from one post to another post to form a basis of attachment for said panels.

7. A racetrack guard as claimed in claim 6 wherein said panel attachment means comprises:

a flange on each lengthwise edge of said panel for attachment to said metal strip.

8. A racetrack guard as claimed in claim 7 wherein:

said panel contacts said posts substantially only at its points of attachment so that said panel extends above said posts.

9. A racetrack guard as claimed in claim 8 wherein:

said panels ar embbossed to provide strength and improved shock absorption.

10. A racetrack guard as claimed in claim 9 wherein:

the exposed surfaces of said rail are substantially rounded and smooth.

11. A racetrack guard as claimed in claim 9 wherein:

said embossing pattern is designed to direct objects impacting said panel away from the racetrack.

12. A racetrack guard as claimed in claim 7 wherein:

said rail is attached to said post by means of a metal bracket welded to its end and bolted to said rail.

13. A racetrack guard as claimed in claim 7 wherein:

said panel flange for attachment to said post is in the form of a right angle bend from said major suraface.

14. A racetrack guard as claimed in claim 12 wherein: said panel flange for attachment to said metal strip is in the form of an upwardly bent obtuse angle.

15. The combination of a racetrack guard and a rail and post combination comprising:

a plurality of fixed posts, each having a curved section bending inwardly toward the racetrack;

a rail attached to said posts at the ends thereof facing the interior of the racetrack; and, a plurality of panels having major surfaces attached to said rail and said posts spanning said posts in continuing relationship to provide a cover by said major surfaces over said posts to protect a rider from impact against said posts when being thrown downwardly.

16. The combination as claimed in claim 15 wherein: said panels have a curved cross-section.

17. The combination as claimed in claim 15 wherein: said panels have roughly an L-shaped cross-section.

18. The improvement in a racetrack rail with inwardly projecting fixed curved posts supporting said rail wherein the improvement comprises:

panels in substantially continuous relationship spanning said posts having major surfaces covering and overlying the inwardly projecting portions of said posts to protect a rider from impacting against said posts through being deflected by the major surface of said panels.

* * * * *